US010300594B2

(12) United States Patent
Hartsock

(10) Patent No.: US 10,300,594 B2
(45) Date of Patent: May 28, 2019

(54) TOOL PROTECTING AND ORGANIZING DEVICE

(71) Applicant: Paul Hartsock, Millport, NY (US)

(72) Inventor: Paul Hartsock, Millport, NY (US)

( * ) Notice: Subject to any disclaimer, the term of this patent is extended or adjusted under 35 U.S.C. 154(b) by 0 days.

(21) Appl. No.: 15/652,065

(22) Filed: Jul. 17, 2017

(65) Prior Publication Data

US 2019/0015968 A1 Jan. 17, 2019

(51) Int. Cl.

| | |
|---|---|
| ***B25H 3/02*** | (2006.01) |
| ***B65D 25/10*** | (2006.01) |
| ***B65D 25/04*** | (2006.01) |
| ***B65D 43/14*** | (2006.01) |
| ***B65D 51/24*** | (2006.01) |
| ***B65D 81/107*** | (2006.01) |

(52) U.S. Cl.

CPC ..... *B25H 3/02* (2013.01); *B65D 25/04* (2013.01); *B65D 25/108* (2013.01); *B65D 43/14* (2013.01); *B65D 51/242* (2013.01); *B65D 81/107* (2013.01)

(58) Field of Classification Search

CPC ..... B25H 3/02; B25H 3/021; B25H 3/022; B25H 3/023; B25H 3/026; B65D 25/04; B65D 25/108; B65D 51/242; B65D 81/107

USPC ..... 206/373, 553–556; 220/500, 736, 735

See application file for complete search history.

(56) References Cited

U.S. PATENT DOCUMENTS

| | | | | |
|---|---|---|---|---|
| 3,642,998 | A * | 2/1972 | Jennings | B25H 3/02 206/207 |
| 4,356,916 | A | 11/1982 | Anglemyer | |
| 5,347,746 | A * | 9/1994 | Letson | A01K 97/06 206/315.11 |
| 5,669,495 | A | 9/1997 | West | |
| 5,680,932 | A * | 10/1997 | Dickinson | B25H 3/02 206/338 |
| 6,425,511 | B1 | 7/2002 | Dodson | |
| 7,150,345 | B2 | 12/2006 | Redzisz | |
| D704,441 | S | 5/2014 | Machuca | |
| 2014/0262873 | A1 | 9/2014 | Lorentz | |
| 2015/0206520 | A1 | 7/2015 | Hoeft et al. | |
| 2018/0134452 | A1* | 5/2018 | Busch | B44D 3/04 |

FOREIGN PATENT DOCUMENTS

| | | |
|---|---|---|
| WO | WO9846399 | 4/1998 |

* cited by examiner

*Primary Examiner* — Andrew D Perreault

(57) ABSTRACT

A tool protecting and organizing device for drywall installers includes a housing. The housing has a top that is open. A lid is configured to reversibly couple to the housing to close the top. A wall is coupled to the housing. The wall extends between opposing sides of the housing to define first and second compartments. The first compartment is configured to position items, such as a sanding block and a screw gun, to retain the items in the housing. A plate is coupled to and extends between the wall and a second end of the housing to define an upper chamber and a lower chamber within the second compartment. Each of a plurality of slots that is positioned through the plate is configured to insert a portion of a respective tool, such as a trowel and a mud pan, to fixedly position the tool in the housing.

17 Claims, 4 Drawing Sheets

TOOL PROTECTING AND ORGANIZING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98

The disclosure and prior art relates to organizing devices and more particularly pertains to a new organizing device for drywall installers.

BRIEF SUMMARY OF THE INVENTION

An embodiment of the disclosure meets the needs presented above by generally comprising a housing. The housing has a top that is open. A lid is configured to reversibly couple to the housing to close the top. A wall is coupled to the housing. The wall extends between opposing sides of the housing to define first and second compartments. The first compartment is configured to position items, such as a sanding block and a screw gun, to retain the items in the housing. A plate is coupled to and extends between the wall and a second end of the housing to define an upper chamber and a lower chamber within the second compartment. Each of a plurality of slots that is positioned through the plate is configured to insert a portion of a respective tool, such as a trowel and a mud pan, to fixedly position the tool in the housing.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
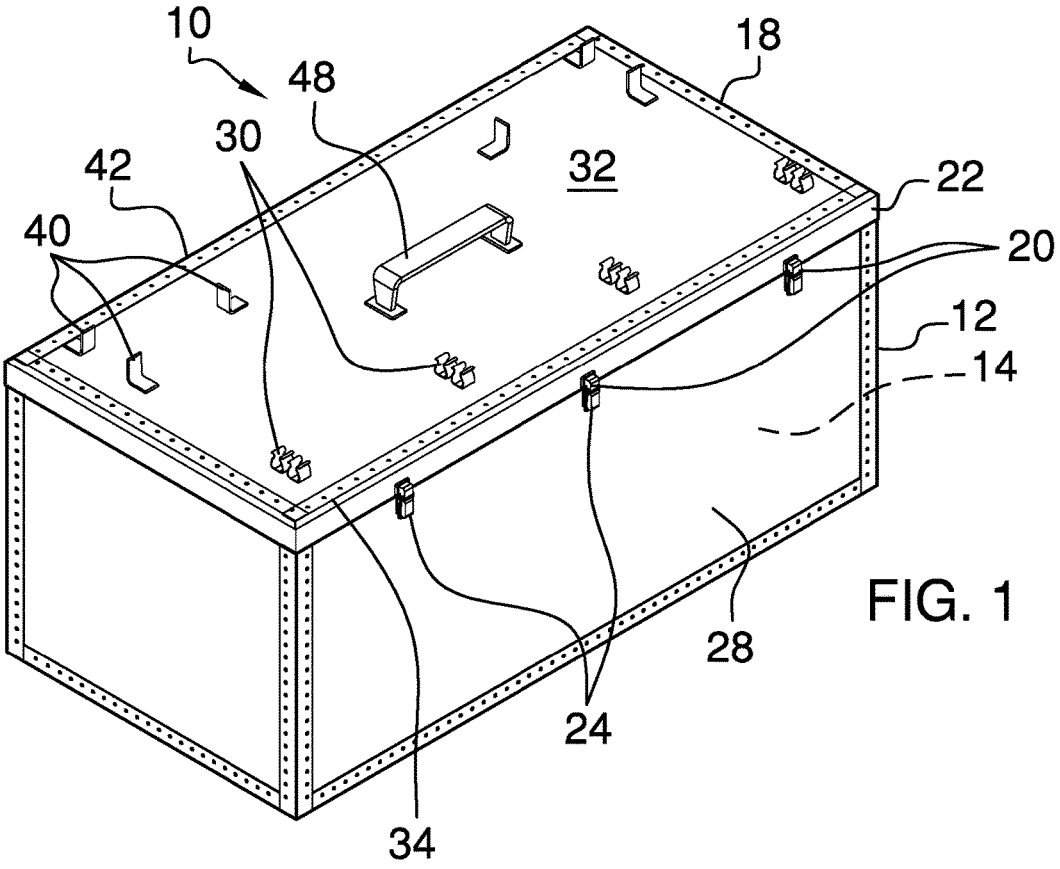
FIG. 1 is an isometric perspective view of a tool protecting and organizing device according to an embodiment of the disclosure.
Figure 2:
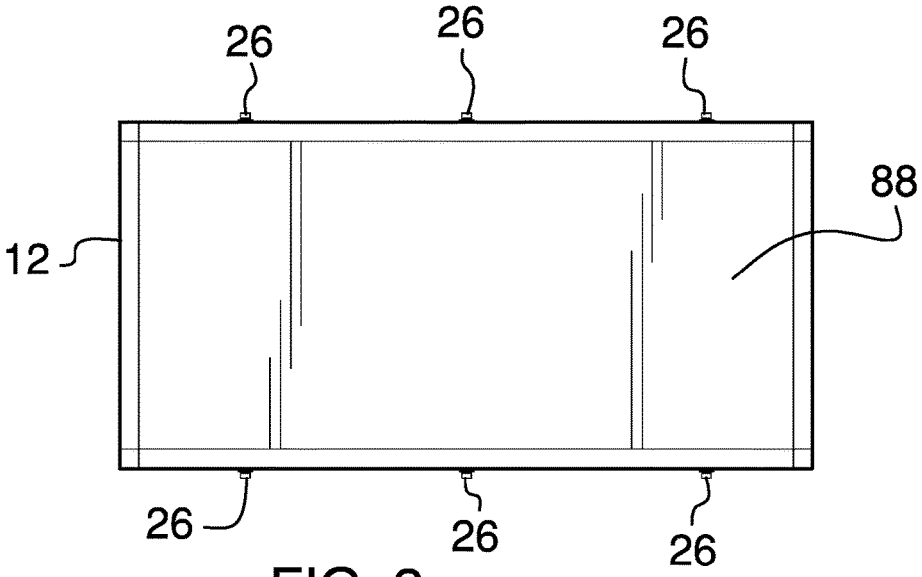
FIG. 2 is a bottom view of an embodiment of the disclosure.
Figure 3:
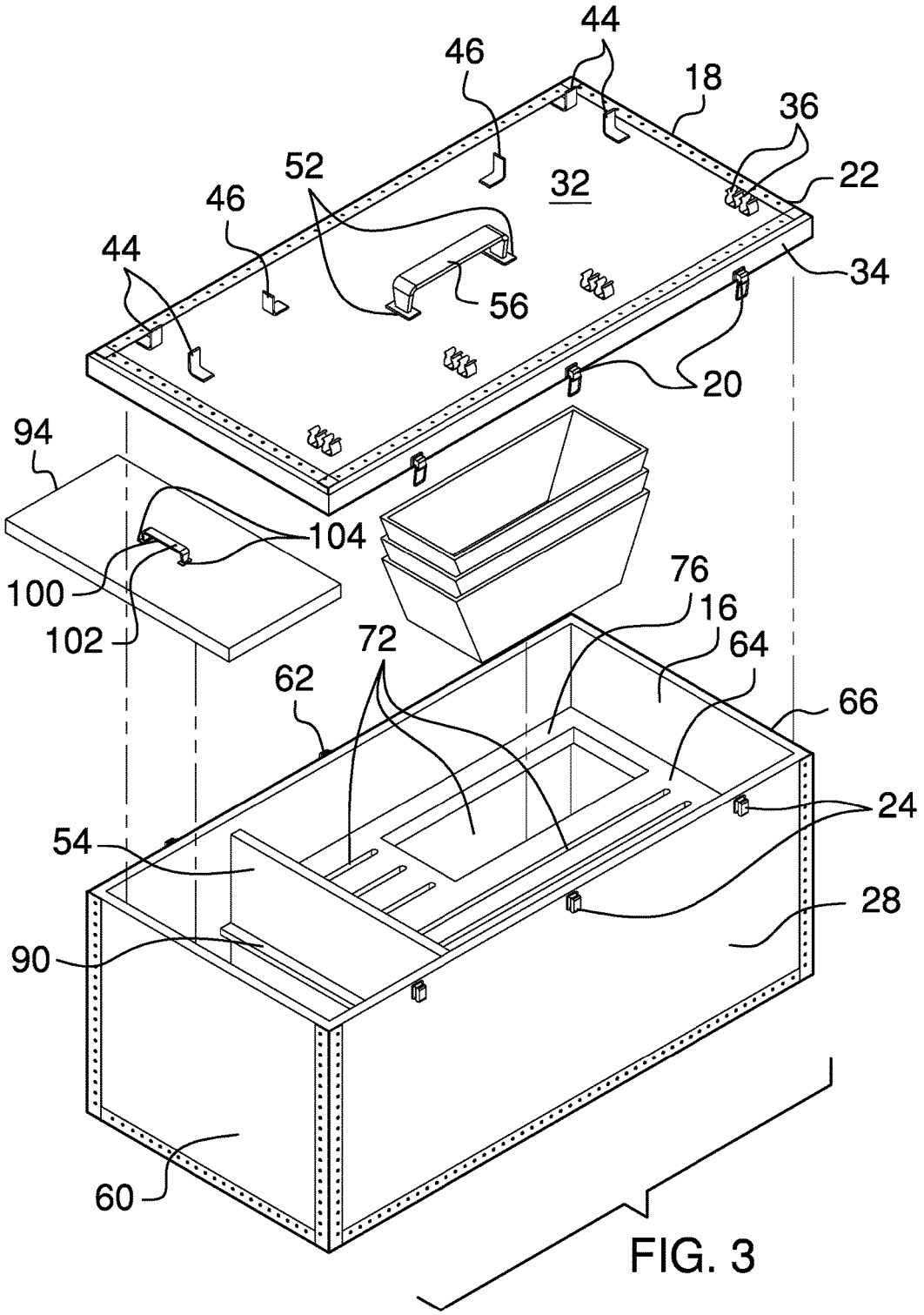
FIG. 3 is an exploded view of an embodiment of the disclosure.
Figure 4:
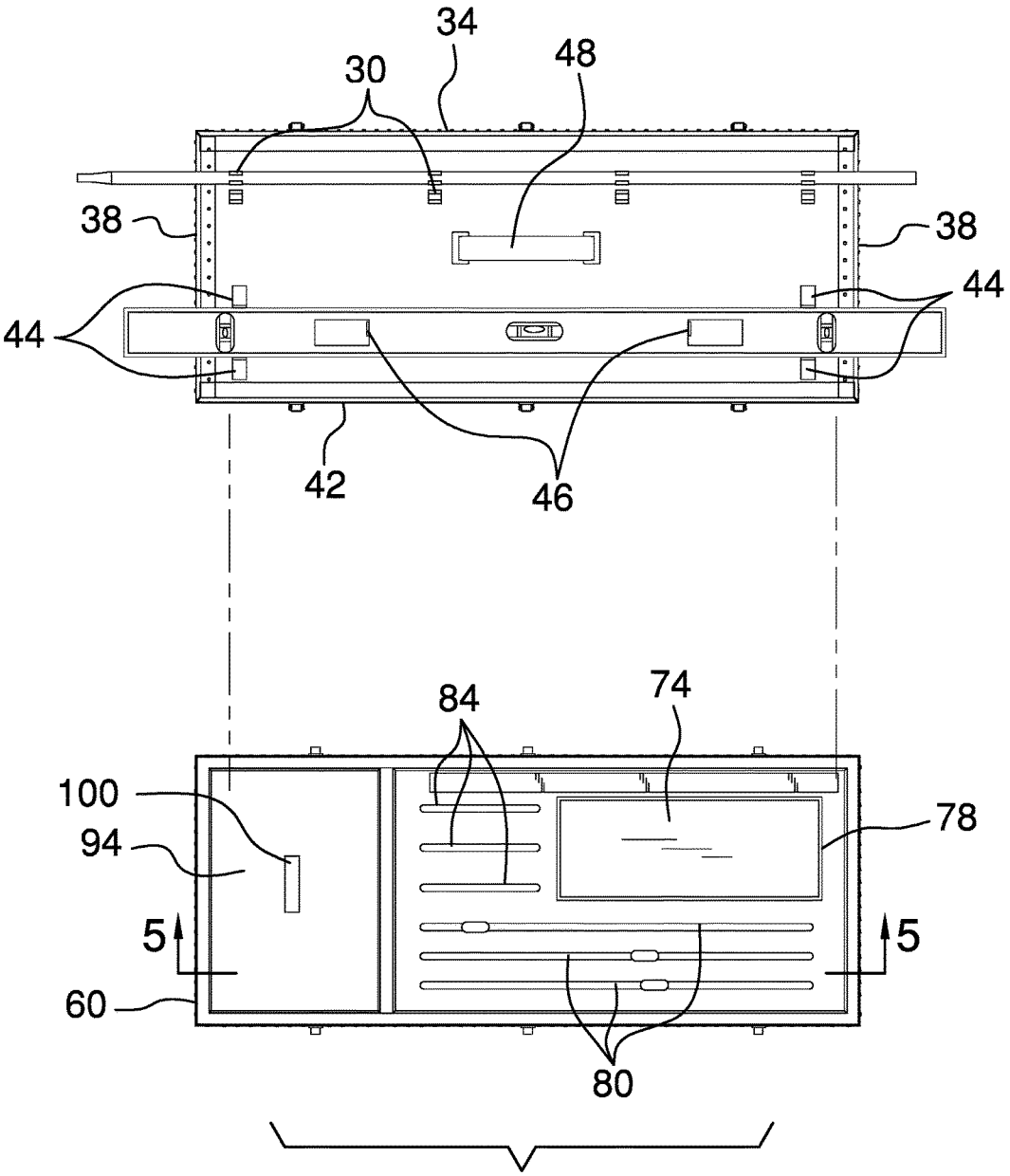
FIG. 4 is a top view of an embodiment of the disclosure.
Figure 5:
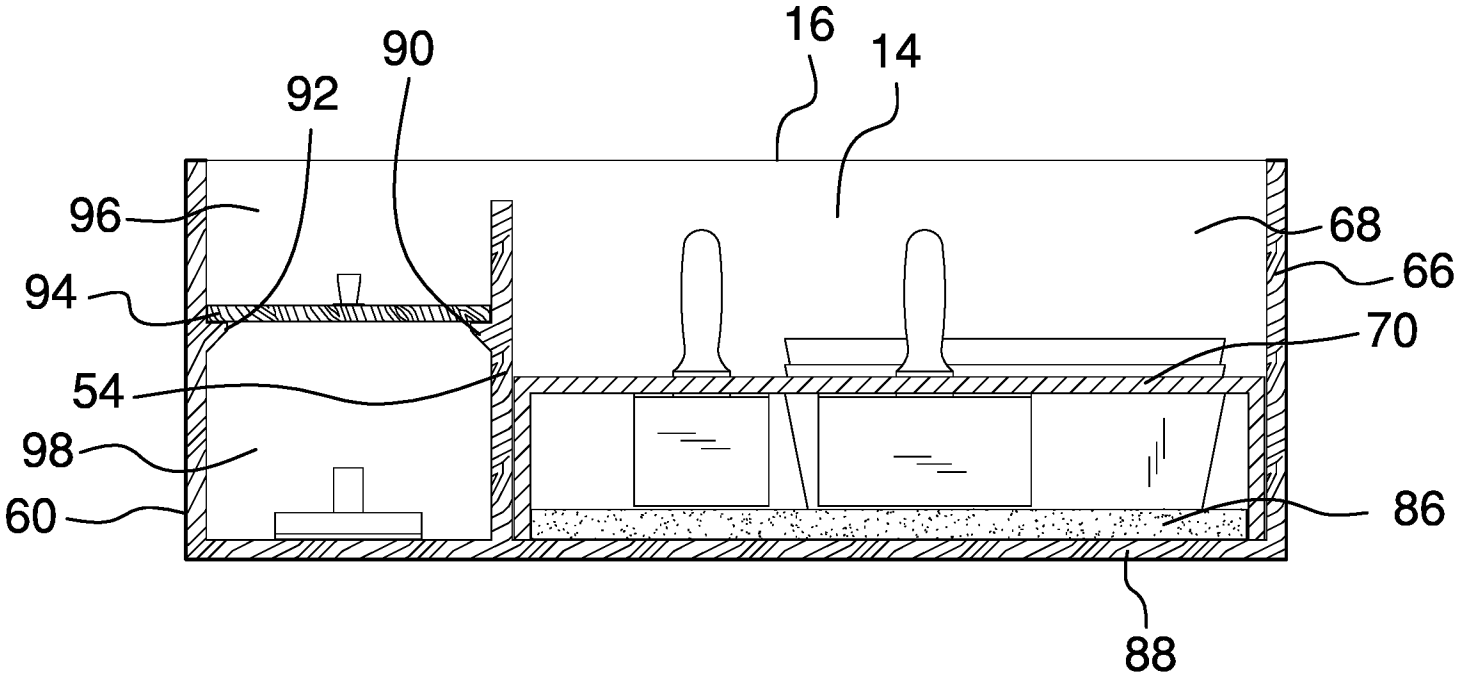
FIG. 5 is a cross-sectional view of an embodiment of the disclosure.

With reference now to the drawings, and in particular to FIGS. 1 through 5 thereof, a new organizing device embodying the principles and concepts of an embodiment of the disclosure and generally designated by the reference numeral 10 will be described.

As best illustrated in FIGS. 1 through 5, the tool protecting and organizing device 10 generally comprises a housing 12 that defines an interior space 14. The housing 12 has a top 16 that is open. In one embodiment, the housing 12 is substantially rectangularly box shaped.

The device 10 comprises a lid 18 that is complementary to the top 16 of the housing 12. The lid 18 is configured to reversibly couple to the housing 12 to close the top 16.

A plurality of first connectors 20 is coupled to a circumference 22 of the lid 18. A plurality of second connectors 24 is coupled to the housing 12 proximate to the top 16. The second connectors 24 are complementary to the first connectors 20. Each second connector 24 is positioned to selectively couple to a respective first connector 20 to couple the lid 18 to the housing 12 to close the top 16. In one embodiment, each second connector 24 and the respective first connector 20 comprise a clasp fastener 26. In another embodiment, the plurality of second connectors 24 comprises six second connectors 24 that are positioned on and equally distributed between opposing sides 28 of the housing 12.

A plurality of first fasteners 30 is coupled to an upper face 32 of the lid 18 proximate to a first edge 34 of the lid 18. The plurality of first fasteners 30 is configured to couple to at least one tubular article, such as a sanding pole, to couple the at least one tubular article to the lid 18. In one embodiment, the plurality of first fasteners 30 comprises eight first fasteners 30 that are distributed evenly between a pair of rows 36. Each row 36 extends between opposing ends 38 of the lid 18. In another embodiment, each first fastener 30 is C-shaped and resilient so that each first fastener 30 is configured to insert and couple to the at least one tubular article.

A plurality of second fasteners 40 is coupled to the upper face 32 of the lid 18 proximate to a second edge 42 of the lid 18. The plurality of second fasteners 40 is configured to couple to a first level to couple the first level to the lid 18.

In one embodiment, the plurality of second fasteners 40 comprises two pairs of first brackets 44 that are positioned singly proximate to the opposing ends 38 of the lid 18. Each pair of first brackets 44 is positioned to couple to edges of the first level to couple the first level to the lid 18. The plurality of second fasteners 40 also comprises two second brackets 46 that are evenly spaced between the pairs of first brackets 44. Each second bracket 46 is positioned to be inserted into a respective penetration that is positioned through the first level to couple the first level to the lid 18. In another embodiment, each first bracket 44 and each second bracket 46 is L-shaped and resilient.

A handle 48 is coupled to the lid 18. The handle 48 is configured to be grasped in a hand of the user to selectively position the lid 18 on the housing 12 to close the top 16. In one embodiment, the handle 48 is centrally positioned on the lid 18. In another embodiment, the handle 48 comprises a first bar 50 that has opposing termini 52. Each opposing terminus 52 is coupled to the lid 18. The first bar 50 is configured to insert the hand of the user between the first bar 50 and the lid 18 to grasp the first bar 50 to selectively position the lid 18 on the housing 12 to close the top 16.

A wall 54 is coupled to the housing 12 and is positioned in the interior space 14. The wall 54 extends between the opposing sides 28 of the housing 12 to define a first compartment 56 and a second compartment 58. The first compartment 56 is configured to position items, such as a sanding block and a screw gun, to retain the items in the interior space 14. In one embodiment, the wall 54 is positioned substantially equally distant from a first end 60 and a midpoint 62 of the housing 12.

A plate 64 is coupled to and extends between the wall 54 and a second end 66 of the housing 12 to define an upper chamber 68 and a lower chamber 70 within the second compartment 58.

A plurality of slots 72 is positioned through the plate 64. Each slot 72 is configured to insert a portion of a respective tool, such as a trowel and a mud pan, to fixedly position the tool in the interior space 14. In one embodiment, the plurality of slots 72 comprises an opening 74. The opening 74 is shaped complementarily to the mud pan. The opening 74 is configured to insert the bottom portion of the mud pan to fixedly position the mud pan in the interior space 14. The opening 74 defines a ledge 76 that is positioned on the plate 64 between a perimeter 78 of the opening 74 and a respective opposing side 28 of the housing 12. The ledge 76 is configured to position an article, such as a second level, to retain the article in the upper chamber 68.

In another embodiment, the plurality of slots 72 comprises a set of three long slits 80. The long slits 80 extend from proximate to opposing edges 82 of the plate 64. Each long slit 80 is configured to insert a blade of at least one wide trowel to fixedly position the at least one wide trowel in the interior space 14. In yet another embodiment, the plurality of slots 72 comprises a set of three short slits 84. The short slits 84 extend from proximate to the opening 74 to proximate to a respective opposing edge 82 of the plate 64. Each short slit 84 is configured to insert the blade of at least one narrow trowel to fixedly position the at least one narrow trowel in the interior space 14.

A pad 86 is positioned on a bottom 88 of the housing 12 in the lower chamber 70. The pad 86 is configured to cushion the tool that is positioned through the respective slot 72. In one embodiment, the pad 86 comprises foam. In another embodiment, the pad 86 comprises closed-cell extruded polystyrene foam.

A first slat 90 and a second slat 92 are positioned horizontally in the first compartment 56. The first slat 90 is coupled to the wall 54 and the second slat 92 is coupled to the first end 60 of the housing 12. A panel 94 is configured to selectively position in the first compartment 56 upon the first slat 90 and the second slat 92 to define a top chamber 96 and a bottom chamber 98.

A grasp 100 is coupled to the panel 94. The grasp 100 is configured to be grasped in the hand of the user to selectively position the panel 94 on the first slat 90 and the second slat 92 to close the bottom chamber 98. In one embodiment, the grasp 100 comprises a second bar 102 that has opposing endpoints 104. Each opposing endpoint 104 is coupled to the panel 94. The second bar 102 is configured to insert the hand of the user between the second bar 102 and the panel 94 to grasp the second bar 102 to selectively position the panel 94 on the first slat 90 and the second slat 92 to close the bottom chamber 98.

In use, the handle 48 is configured to be grasped in the hand of the user to selectively position the lid 18 on the housing 12 to close the top 16. Each second connector 24 is positioned to selectively couple to the respective first connector 20 to couple the lid 18 to the housing 12 to close the top 16. The plurality of first fasteners 30 is configured to couple to the at least one tubular article to couple the at least one tubular article to the lid 18. Each pair of first brackets 44 is positioned to couple to the edges of the first level to couple the first level to the lid 18. Each second bracket 46 is positioned to be inserted into the respective penetration that is positioned through the first level to couple the first level to the lid 18. The first compartment 56 is configured to position the items, such as the sanding block and the screw gun, to retain the items in the interior space 14. The grasp 100 is configured to be grasped in the hand of the user to selectively position the panel 94 on the first slat 90 and the second slat 92 to close the bottom chamber 98. The opening 74 that is positioned in the plate 64 is configured to insert the bottom portion of the mud pan to fixedly position the mud pan in the interior space 14. The ledge 76 that is positioned on the plate 64 is configured to position the article, such as the second level, to retain the article in the upper chamber 68. The long slits 80 that are positioned in the plate 64 are each configured to insert the blade of at least one wide trowel to fixedly position the at least one wide trowel in the interior space 14. The short slits 84 that are positioned in the plate 64 are each configured to insert the blade of at least one narrow trowel to fixedly position the at least one narrow trowel in the interior space 14. The pad 86 that is positioned in the lower chamber 70 is configured to cushion the tools that are positioned through the slots 72.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tool protecting and organizing device comprising:

a housing defining an interior space, said housing having a top, said top being open;

a lid complementary to said top of said housing, said lid being configured for reversibly coupling to said housing for closing said top;

a wall coupled to said housing and positioned in said interior space, said wall extending between opposing sides of said housing defining a first compartment and a second compartment;

a plate coupled to and extending between said wall and a second end of said housing defining an upper chamber and a lower chamber within said second compartment;

a plurality of slots positioned through said plate;

a plurality of first fasteners, said plurality of first fasteners being configured for coupling to at least one tubular article;

a plurality of second fasteners coupled to an upper face of said lid proximate to a second edge of said lid, said plurality of second fasteners being configured for coupling to a first level, wherein said second fasteners are positioned on said lid such that said plurality of second fasteners is configured for coupling to the first level for coupling the first level to said lid, said plurality of second fasteners comprising two pairs of first brackets positioned singly proximate to opposing ends of said lid, two second brackets evenly spaced between said pairs of first brackets, each said first bracket and each said second bracket being L-shaped and resilient, and wherein said pairs of first brackets are positioned on said lid such that each said pair of first brackets is positioned for coupling to edges of the first level for coupling the first level to said lid, wherein said second brackets are positioned on said lid such that each said second bracket is positioned for inserting into a respective penetration positioned through the first level for coupling the first level to said lid; and wherein said wall is positioned in said interior space such that said first compartment is configured for positioning items, such as a sanding block and a screw gun, for retaining the items in said interior space, wherein said slots are positioned in said plate such that each said slot is configured for inserting a portion of a respective tool, such as a trowel and a mud pan, for fixedly positioning the tool in said interior space.

2. The device of claim 1, further including said housing being substantially rectangularly box shaped.

3. The device of claim 1, further comprising:

a plurality of first connectors coupled to a circumference of said lid;

a plurality of second connectors coupled to said housing proximate to said top, said second connectors being complementary to said first connectors; and wherein each said second connector is positioned on said housing such that said second connector is positioned for selectively coupling to a respective said first connector for coupling said lid to said housing for closing said top.

4. The device of claim 3, further including each said second connector and said respective said first connector comprising a clasp fastener.

5. The device of claim 3, further including said plurality of second connectors comprising six said second connectors positioned on and equally distributed between said opposing sides of said housing.

6. The device of claim 1, further including said plurality of first fasteners being coupled to an upper face of said lid proximate to a first edge of said lid, wherein said first fasteners are positioned on said lid such that said plurality of first fasteners is configured for coupling to the at least one tubular article for coupling the at least one tubular article to said lid.

7. The device of claim 6, further including said plurality of first fasteners comprising eight said first fasteners distributed evenly between a pair of rows, each said row extending between opposing ends of said lid, each said first fastener being C-shaped and resilient such that said first fastener is configured for inserting and coupling to the at least one tubular article.

8. The device of claim 1, further including a handle coupled to said lid, said handle being centrally positioned on said lid, wherein said handle is positioned on said lid such that said handle is configured for grasping in a hand of the user for selectively positioning said lid on said housing for closing said top.

9. The device of claim 8, further including said handle comprising a first bar having opposing termini, each said opposing terminus being coupled to said lid, wherein said first bar is positioned on said lid such that said first bar is configured for inserting the hand of the user between said first bar and said lid for grasping said first bar for selectively positioning said lid on said housing for closing said top.

10. The device of claim 1, further including said wall being positioned substantially equally distant from a first end and a midpoint of said housing.

11. The device of claim 1, further including said plurality of slots comprising:

an opening, said opening being shaped complementarily to the mud pan, said opening defining a ledge positioned on said plate between a perimeter of said opening and a respective said opposing side of said housing;

a set of three long slits, said long slits extending from proximate to opposing edges of said plate;

a set of three short slits, said short slits extending from proximate to said opening to proximate to a respective said opposing edge of said plate; and wherein said opening is positioned in said plate such that said opening is configured for inserting the bottom portion of the mud pan for fixedly positioning the mud pan in said interior space, wherein said ledge is positioned on said plate such that said ledge is configured for positioning an article, such as a second level, for retaining the article in said upper chamber, wherein said long slits are positioned in said plate such that each said long slit is configured for inserting a blade of at least one wide trowel for fixedly positioning the at least one wide trowel in said interior space, wherein said short slits are positioned in said plate such that each said short slit is configured for inserting the blade of at least one narrow trowel for fixedly positioning the at least one narrow trowel in said interior space.

12. The device of claim 1, further including a pad positioned on a bottom of said housing in said lower chamber, wherein said pad is positioned in said lower chamber such that said pad is configured for cushioning the tool positioned through said respective said slot.

13. The device of claim 12, further including said pad comprising foam.

14. The device of claim 13, further including said pad comprising closed-cell extruded polystyrene foam.

15. The device of claim 1, further comprising:

a first slat and a second slat positioned horizontally in said first compartment, said first slat being coupled to said wall, said second slat being coupled to a first end of said housing;

a panel configured for selectively positioning in said first compartment upon said first slat and said second slat defining a top chamber and a bottom chamber;

a grasp coupled to said panel; and wherein said grasp is positioned on said panel such that said grasp is configured for grasping in the hand of the user for selectively positioning said panel on said first slat and said second slat for closing said bottom chamber.

16. The device of claim 15, further including said grasp comprising a second bar having opposing endpoints, each said opposing endpoint being coupled to said panel, wherein said second bar is positioned on said panel such that said second bar is configured for inserting the hand of the user between said second bar and said panel for grasping said second bar for selectively positioning said panel on said first slat and said second slat for closing said bottom chamber.

17. A tool protecting and organizing device comprising:

a housing defining an interior space, said housing having a top, said top being open, said housing being substantially rectangularly box shaped;

a lid complementary to said top of said housing, said lid being configured for reversibly coupling to said housing for closing said top;

a plurality of first connectors coupled to a circumference of said lid;

a plurality of second connectors coupled to said housing proximate to said top, said second connectors being complementary to said first connectors, wherein each said second connector is positioned on said housing such that said second connector is positioned for selectively coupling to a respective said first connector for coupling said lid to said housing for closing said top, each said second connector and said respective said first connector comprising a clasp fastener, said plurality of second connectors comprising six said second connectors positioned on and equally distributed between opposing sides of said housing;

a plurality of first fasteners coupled to an upper face of said lid proximate to a first edge of said lid, said plurality of first fasteners being configured for coupling to at least one tubular article, such as a sanding pole, wherein said first fasteners are positioned on said lid such that said plurality of first fasteners is configured for coupling to the at least one tubular article for coupling the at least one tubular article to said lid, said plurality of first fasteners comprising eight said first fasteners distributed evenly between a pair of rows, each said row extending between opposing ends of said lid, each said first fastener being C-shaped and resilient such that said first fastener is configured for inserting and coupling to the at least one tubular article;

a plurality of second fasteners coupled to said upper face of said lid proximate to a second edge of said lid, said plurality of second fasteners being configured for coupling to a first level, wherein said second fasteners are positioned on said lid such that said plurality of second fasteners is configured for coupling to the first level for coupling the first level to said lid, said plurality of second fasteners comprising two pairs of first brackets positioned singly proximate to said opposing ends of said lid, wherein said pairs of first brackets are positioned on said lid such that each said pair of first brackets is positioned for coupling to edges of the first level for coupling the first level to said lid, said plurality of second fasteners comprising two second brackets evenly spaced between said pairs of first brackets, wherein said second brackets are positioned on said lid such that each said second bracket is positioned for inserting into a respective penetration positioned through the first level for coupling the first level to said lid, each said first bracket and each said second bracket being L-shaped and resilient;

a handle coupled to said lid, wherein said handle is positioned on said lid such that said handle is configured for grasping in a hand of the user for selectively positioning said lid on said housing for closing said top, said handle being centrally positioned on said lid, said handle comprising a first bar having opposing termini, each said opposing terminus being coupled to said lid, wherein said first bar is positioned on said lid such that said first bar is configured for inserting the hand of the user between said first bar and said lid for grasping said first bar for selectively positioning said lid on said housing for closing said top;

a wall coupled to said housing and positioned in said interior space, said wall extending between said opposing sides of said housing defining a first compartment and a second compartment, wherein said wall is positioned in said interior space such that said first compartment is configured for positioning items, such as a sanding block and a screw gun, for retaining the items in said interior space, said wall being positioned substantially equally distant from a first end and a midpoint of said housing;

a plate coupled to and extending between said wall and a second end of said housing defining an upper chamber and a lower chamber within said second compartment;

a plurality of slots positioned through said plate, wherein said slots are positioned in said plate such that each said slot is configured for inserting a portion of a respective tool, such as a trowel and a mud pan, for fixedly positioning the tool in said interior space, said plurality of slots comprising an opening, said opening being shaped complementarily to the mud pan, wherein said opening is positioned in said plate such that said opening is configured for inserting the bottom portion of the mud pan for fixedly positioning the mud pan in said interior space, said opening defining a ledge positioned on said plate between a perimeter of said opening and a respective said opposing side of said housing, wherein said ledge is positioned on said plate such that said ledge is configured for positioning an article, such as a second level, for retaining the article in said upper chamber, said plurality of slots comprising a set of three long slits, said long slits extending from proximate to opposing edges of said plate, wherein said long slits are positioned in said plate such that each said long slit is configured for inserting a blade of at least one wide trowel for fixedly positioning the at least one wide trowel in said interior space, said plurality of slots comprising a set of three short slits, said short slits extending from proximate to said opening to proximate to a respective said opposing edge of said plate, wherein said short slits are positioned in said plate such that each said short slit is configured for inserting the blade of at least one narrow trowel for fixedly positioning the at least one narrow trowel in said interior space;

a pad positioned on a bottom of said housing in said lower chamber, wherein said pad is positioned in said lower chamber such that said pad is configured for cushioning the tool positioned through said respective said slot, said pad comprising foam, said pad comprising closed-cell extruded polystyrene foam;

a first slat and a second slat positioned horizontally in said first compartment, said first slat being coupled to said wall, said second slat being coupled to said first end of said housing;

a panel configured for selectively positioning in said first compartment upon said first slat and said second slat defining a top chamber and a bottom chamber;

a grasp coupled to said panel, wherein said grasp is positioned on said panel such that said grasp is configured for grasping in the hand of the user for selectively positioning said panel on said first slat and said second slat for closing said bottom chamber, said grasp comprising a second bar having opposing endpoints, each said opposing endpoint being coupled to said panel, wherein said second bar is positioned on said panel such that said second bar is configured for inserting the hand of the user between said second bar and said panel for grasping said second bar for selectively positioning said panel on said first slat and said second slat for closing said bottom chamber; and wherein said handle is positioned on said lid such that said handle is configured for grasping in the hand of the user for selectively positioning said lid on said housing for closing said top, wherein each said second connector is positioned on said housing such that said second connector is positioned for selectively coupling to said respective said first connector for coupling said lid to said housing for closing said top, wherein said first fasteners are positioned on said lid such that said plurality of first fasteners is configured for coupling to the at least one tubular article for coupling the at least one tubular article to said lid, wherein said pairs of first brackets are positioned on said lid such that each said pair of first brackets is positioned for coupling to the edges of the first level for coupling the first level to said lid, wherein said second brackets are positioned on said lid such that each said second bracket is positioned for inserting into the respective penetration positioned through the first level for coupling the first level to said lid, wherein said wall is positioned in said interior space such that said first compartment is configured for positioning the items, such as the sanding block and the screw gun, for retaining the items in said interior space, wherein said grasp is positioned on said panel such that said grasp is configured for grasping in the hand of the user for selectively positioning said panel on said first slat and said second slat for closing said bottom chamber, wherein said opening is positioned in said plate such that said opening is configured for inserting the bottom portion of the mud pan for fixedly positioning the mud pan in said interior space, wherein said ledge is positioned on said plate such that said ledge is configured for positioning the article, such as the second level, for retaining the article in said upper chamber, wherein said long slits are positioned in said plate such that each said long slit is configured for inserting the blade of the at least one wide trowel for fixedly positioning the at least one wide trowel in said interior space, wherein said short slits are positioned in said plate such that each said short slit is configured for inserting the blade of the at least one narrow trowel for fixedly positioning the at least one narrow trowel in said interior space, wherein said pad is positioned in said lower chamber such that said pad is configured for cushioning the tool positioned through said respective said slot.

* * * * *